United States Patent [19]

Patureau et al.

[11] Patent Number: 5,027,810

[45] Date of Patent: Jul. 2, 1991

[54] SELF-CONTAINED EMERGENCY BREATHING APPARATUS

[75] Inventors: Jean-Pierre Patureau, Marly-le-Roi; Christian Morillon, Boucau, both of France

[73] Assignees: Bertin & Cie, Plaisir, France; Teikoku Sen-I Co., Ltd., Tokyo, Japan

[21] Appl. No.: 490,601

[22] PCT Filed: Jul. 10, 1989

[86] PCT No.: PCT/FR89/00364

§ 371 Date: Mar. 5, 1990

§ 102(e) Date: Mar. 5, 1990

[87] PCT Pub. No.: WO90/00421

PCT Pub. Date: Jan. 25, 1990

[30] Foreign Application Priority Data

Jul. 12, 1988 [FR] France ..... 88 09453

[51] Int. Cl.[5] ..... A62B 18/08

[52] U.S. Cl. ..... 128/206.24; 128/205.12; 128/201.22; 128/201.25

[58] Field of Search ..... 128/201.22, 201.25, 128/205.12, 205.28, 206.24

[56] References Cited

U.S. PATENT DOCUMENTS

| | | | |
|---|---|---|---|
| 2,366,904 | 1/1945 | Haugh | 128/206.25 |
| 3,521,629 | 7/1970 | Reynolds | 128/201.23 |
| 3,976,063 | 8/1976 | Henneman et al. | 128/201.25 |
| 4,440,163 | 4/1984 | Spergel | 128/205.17 |
| 4,552,140 | 11/1985 | Erie | 128/201.25 |

FOREIGN PATENT DOCUMENTS

| | | |
|---|---|---|
| 132021 | 6/1902 | Fed. Rep. of Germany . |
| 277995 | 9/1914 | Fed. Rep. of Germany . |
| 1222801 | 8/1966 | Fed. Rep. of Germany . |
| 730522 | 8/1932 | France . |
| 2284343 | 4/1976 | France . |
| 577435 | 6/1946 | United Kingdom . |

*Primary Examiner*—Edgar S. Burr
*Assistant Examiner*—Lisa E. Malvaso
*Attorney, Agent, or Firm*—Bell, Seltzer, Park & Gibson

[57] ABSTRACT

A self-contained emergency breathing apparatus is provided comprising a hood (10) surrounding substantially sealingly the head of a person and comprising an assembly (18) formed of a cylinder of breathable gas at high pressure, a pressure reducer, an ejection nozzle, a duct for sucking the air contained in the hood and mixing this air with the ejected gas and carbon dioxide absorption means. The apparatus may be stored for a long period of time and be used for a short period of time for escaping from a zone having risks of asphyxiation.

10 Claims, 2 Drawing Sheets

SELF-CONTAINED EMERGENCY BREATHING APPARATUS

The invention relates to a self-contained emergency breathing apparatus intended to be stored for a long period of time and then to be used for a short period of time in order to enable the wearer of the apparatus to move away from a zone in which there is a high risk of asphyxiation.

When a fire occurs in a confined space, for example on board an aircraft, in a theater, in an office or residential building, in a hotel, etc . . . most of the deaths are due to asphyxiation. Proposals have therefore been made, over a considerable period of time, to provide individual emergency apparatuses that can be stored in hotel rooms, offices or residential premises, or which can be carried on the person in certain public locations (e.g. in an auditorium or concert hall). Such apparatuses are designed to have an endurance of about 5 to 10 minutes which is relatively short but sufficient to enable persons wearing them to reach an emergency exit without being asphyxiated. It is also likely that the use of such apparatuses will reduce panic, both on the part of individuals and collectively, and panic is often an additional cause of deaths and accidents.

The apparatuses which are currently available commercially comprise a mask or hood intended to envelop the head of a person, and are provided with filters of varying degrees of sophistication, for the purpose of absorbing toxic components in the surrounding air before the air is breathed by the person wearing the apparatus.

Apparatuses of this type are generally capable of being stored for a relatively long period of time without losing effectiveness, and they are relatively reliable since they do not include any moving parts. They are also simple to use since they merely need placing over the head and tying around the neck in order to avoid filling with smoke or other toxic compounds.

Their drawbacks stem from the principle on which they operate : at the present time no filtering materials exist capable of absorbing all the toxic compounds likely to be released by fires. The manufacturers of such apparatuses therefor make an initial selection of filtering materials, which will absorb some toxic components and let others pass. There are therefore some types of fire where these masks are ineffective. In addition, they are of little use if the level of oxygen in the surrounding air falls below a predetermined limit. Finally, it is necessary for the filtering materials be checked and replaced at regular intervals in order to avoid loss of filtering capacity.

Self-contained breathing apparatus have also been proposed comprising their own air or oxygen supplies, and some of these apparatuses are capable of operating in a closed circuit, because they include air regeneration means such as means for absorbing carbon dioxide and water vapour. These apparatuses are generally sophisticated, expensive, and intended for use by professionals in special circumstances. Others are intended to be used by the public for a short lapse of time, but they are generally poorly designed and cannot provide the results expected.

The object of the invention is to provide a self-contained emergency breathing apparatus having a high degree of reliability, capable of being stored for a long period of time and remaining usable without loss of capacity and is simple and easy to use by non specialized persons.

Another object is also to provide an apparatus of this type, which performs very much better than competitive apparatus.

A breathing apparatus of the above type is therefore proposed comprising a mask or hood for covering a large portion of the head of the user in substantially air-tight manner, oxygen supply means and carbon dioxide absorbing means, the apparatus being characterized in that the oxygen supply means comprise a cylinder having a volume of about 100 $cm^3$ or so, filled at an initial pressure of about 200 bars with a breathable oxygen containing gas, means for expanding said gas to a pressure which is several times greater than the ambient pressure and an ejection nozzle connected by the expander means to the cylinder and opening out into an air passage duct for sucking air contained in the hood and mixing said air with the gas leaving the nozzle, the flowrate of the cylinder being about 2 to 4 liters per minute, the nozzle associated with the air passage duct having an entrainment ratio of 10 to 20.

The apparatus according to the invention is of the self-contained type operating in a closed circuit, thus avoiding all the drawbacks associated with prior art apparatuses that filter outside air. In addition, the apparatus of the invention is highly reliable (no moving parts) and is independent of any external energy source, with the speed at which the gas leaves the ejection nozzle being sufficient to entrain and thus circulate and mix the air contained in the hood with the gas leaving the cylinder, the carbon dioxide (and also possibly water vapour) contained in the air being eliminated by passing over absorbing materials.

The small weight and volume of the cylinder also form an essential advantage of the invention : a cylinder of a volume of about 100 $cm^3$ filled with a breathable gas containing 60 to 70% oxygen is sufficient to provide independent working for about 5 to 10 minutes, while maintaining the carbon dioxide concentration in the mask to a value less than a threshold of about 5%, beyond which risks of intoxication or discomfort exist.

According to another characteristic of the invention, said ejection nozzle has an outlet diameter of about 0.35 mm.

The middle portion of the air passage duct is formed by a mixer with substantially constant section, and has a diameter of about 3.5 mm and a length of about 25 mm.

The downstream portion of this duct is formed by a diffuser so that the pressure of the gases leaving the duct is slightly greater than the surrounding pressure, this diffuser comprising a truncated cone shaped portion having an angle at the apex of about $3^o$ and ending in a bell mouth having a diameter of about 11 mm.

The ejection nozzle is fed with breathable gas at a pressure between about 4 and 10 bars.

All the above means, namely the cylinder, the expander means, the carbon dioxide and possibly water vapour absorbing means, the ejection nozzle and the air passage duct are contained inside the hood.

The latter is advantageously made from a light and transparent heat resistant material such as a polyimide. Advantageously, a portion of the external surface of the hood may be metal coated.

The invention will be better understood and other features, details and advantages thereof will be clear from the following description, given by way of example with reference to the accompanying drawings in which.

Figure 1:
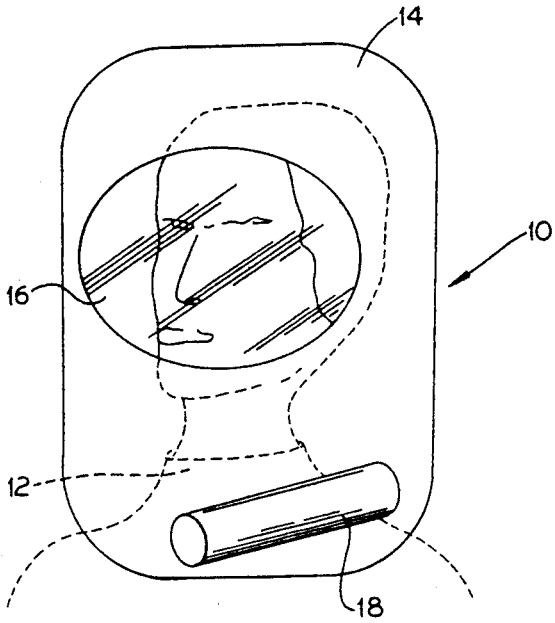
FIG. 1 is a diagrammatic perspective view of an apparatus according to the invention, in use.

The apparatus shown in FIG. 1 comprises a mask or hood 10 which is substantially in the form of a cylindrical tube closed at its top end and open at its bottom end in order to be passed over the head of a person. The bottom end 12 of the hood may be provided with means for fitting closely around the neck of the person in order to prevent the ingress of air or gas into the hood from the outside. The dimensions of the hood are such that when inflated its internal volume is considerably greater than the volume of the head of a person.

The hood is preferably made from a light, flexible, air-tight or water-proof, transparent plastic material which withstands heat and fire and which is preferably cheap. The polyimide sold under the trademark KAPTON is preferably used.

A large portion 14 of the external surface of the hood may receive a protective metal coating whereas the remaining portion 16 at the level of the person's eyes remains transparent.

Inside the hood 10 there is an assembly 18 for supplying oxygen and for circulating and purifying the air contained in the hood.

Figure 2:
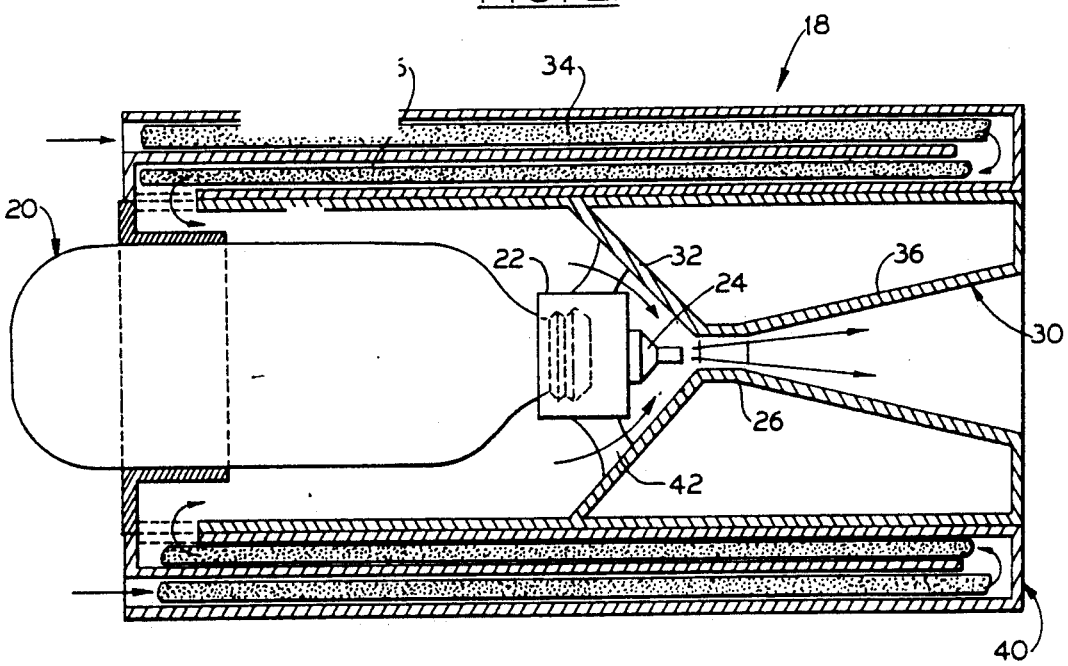
FIG. 2 is a diagrammatic axial section through a particular embodiment of the essential part of the apparatus of the invention.

As can be seen more clearly in FIG. 2, this assembly 18 comprises a small volume cylinder 20 made for example from metal such as steel or aluminium or a composite material and containing a breathable gas under a very high pressure of about 200 bars. The breathable gas may be pure oxygen or, for safety reasons, an oxygen-nitrogen mixture containing 60 to 70% oxygen. Expander means 22, which may be of a conventional type are mounted at the outlet of cylinder 20 for feeding an ejection nozzle 24 with a relatively constant flow of gas at a pressure which is several times greater than the normal ambient pressure and which is for example between about 4 and 10 bars.

The nozzle 24 is located immediately upstream of the neck 26 of an air passage duct whose upstream end 32 defines with nozzle 24 a channel sucking air through a bed 34 of a porous or powdery material such as potassium dioxide $KO_2$, lithium hydroxide LiOH, or preferably soda-containing lime, which is easy to handle, non toxic and cheaper than lithium hydroxide.

To this material may be added silica gel, for absorbing the water vapour.

The absorbing material(s) are disposed in a tubular cylindrical case 40 which surrounds cylinder 20 and duct 30 so as to reduce the total size of the system. Case 40 has for example a triple wall and defines two coaxial chambers in which are placed two tubular cylindrical containers 44, 46 filled with the absorbing material(s). The perforated ends of these containers allow air flow through the absorbing material, following a zig-zag path inside case 40.

The latter is formed with or is mounted on a cylinder 48 also supporting duct 30 and having one end closed by the cylinder 20, so that the upstream end 32 of duct 30 communicates with the outside through the passage containing the absorbing material(s).

The nose of cylinder 20 is screwed for example into a threaded end-piece of the pressure reducer 22 which forms, with the ejection nozzle 24, an assembly held centered inside cylinder 48. The front part of the pressure reducer 22 is for example supported by radial lugs 42 fast with cylinder 48 or with the upstream end 32 of duct 30, for correctly centering nozzle 24 with respect to duct 30.

Duct 30 comprises a mixer 26 of substantially constant section having a certain length, which is connected to a diffuser 36 such that the gas pressure at the outlet of duct 30 is very slightly greater than the pressure inside the hood. Thus, a slight overpressure is obtained inside the hood, which inflates it and prevents outside air from entering, and also a high flow of air sucked into duct 30 is obtained.

The absorption of the carbon dioxide by the material 34 is an exothermic reaction, which results in heating the purified air. The cooling which accompanies any expansion of a pressurized gas is advantageously used for reducing the temperature of the purified air, because of the arrangement of cylinder 20, pressure reducer 22 and nozzle 24 at the inlet of duct 30 in the sucked air path.

Figure 3:
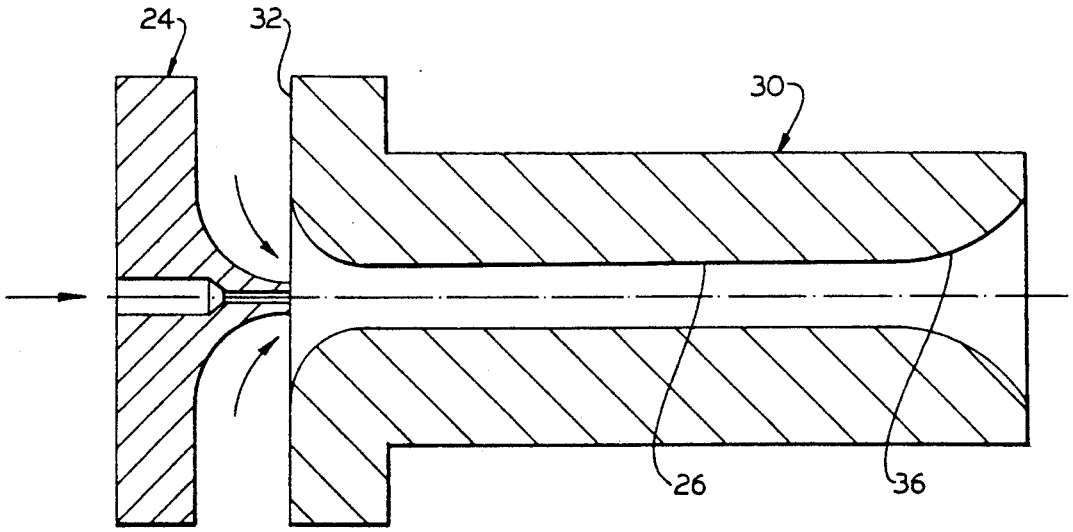
FIG. 3 is an axial section at a larger scale through a nozzle-air duct assembly according to a preferred embodiment of the invention.

The nozzle 24-duct 30 assembly, a preferred embodiment of which has been shown in FIG. 3, must have characteristics making possible a sufficient flow of the air contained in the hood for eliminating the carbon dioxide.

In the embodiment of FIG. 3, nozzle 24 has an upstream diameter of about 2 mm, and a downstream diameter, at its outlet end, of 0.35 mm. The upstream end 32 of duct 30 is connected to mixer 26 by a convex surface having a radius of curvature of about 4 mm. Mixer 26 has a diameter of about 3.5 mm and a length of about 25 mm. and is connected to the diffuser 36 which comprises an upstream truncated cone shaped portion having an angle at the apex of about $3^o$ and a bell-mouthed downstream portion, formed by a convex surface having a radius of curvature of about 6 mm. The downstream end of diffuser 36 may have a diameter of about 11 mm.

The nozzle 24-duct 30 assembly has a length of about 50 mm, the distance between nozzle 24 and the upstream end 32 of duct 30 being about 5 mm.

Such an assembly has an entrainment power between about 10 and 20, and for example equal to 12. The entrainment ratio is the ratio of the airflow sucked into the hood and the driving gas flow delivered by nozzle 24.

According to the invention, this driving gas flow is selected equal to about 3 liters/minute, which causes the suction of an airflow of about 36 liters/minute into the hood; this airflow maintains in the hood a $CO_2$ rate which does not exceed 3% when the person produces a moderate effort.

With these characteristics, cylinder 20 may have a volume of about 100 $cm^3$ and is filled with gas containing 60 to 70% of oxygen at an initial pressure of 200 bars. It provides then for the wearer of the hood independent working of at least 5 minutes. During this time, the carbon dioxide concentration inside the hood, which is initially about 3% in the case of a moderate effort, remains less than 5%, which avoids any risk of intoxication and discomfort for the wearer of the apparatus.

The amount of absorbing material 34 required is about 300 to 400 g.

The apparatus of the invention is intended, in theory, to be stored for a period of possibly several years prior to possible use in the event of an emergency. For that, it is advantageous for it to be protected from the air and humidity in an air-tight wrapping, for example formed by the hood itself and may also be readily checked and replaced if necessary at regular intervals. It is also necessary for the cylinder 20 to be closed in gas-tight manner in order to conserve its internal pressure over a long period of time, and for it to be fitted with rapid opening means, for example by rotation through a quarter of a turn. The apparatus as a whole may comprise automatic tripping means by unfolding the hood and pulling a strap of similar, or by rotation of the cylinder, etc. . .

In an emergency, a person thus unfolds the hood, puts it over his head and tightens it around his neck while simultaneously tripping operation thereof, causing the hood to be inflated.

The gas contained in cylinder 20 is expanded by the means 22 to a pressure of about 4 to 10 bars and reaches the ejection nozzle 24 at a relatively constant flowrate of about 3 liters/minute.

The ejection of this gas flow into duct 30 causes suction of air at a flowrate 10 to 20 times greater through the absorbing material 34, which frees it of carbon dioxide and possibly of water vapour, the air is then cooled by passing through the expander means 22 and 24 and then is mixed with oxygen in portion 26 of duct 30 and leaves at a very low speed from diffuser 36, where it is enriched with oxygen and purified of carbon dioxide and water vapour.

For storage, the apparatus of the invention may be packed in a sealed bag having quick opening means, for example of the type in which a precut strip or a strip predefined by appropriate means is torn or removed.

I claim:

1. Self-contained emergency breathing apparatus intended to be stored for a long period of time and then to be used for a short period of time in order to enable the wearer of the apparatus to move away from a zone in which there is a high risk of asphyxiation, comprising a hood for covering a large portion of the wearer's head in substantially air-tight manner, oxygen supply means and carbon dioxide absorbing means, wherein said oxygen supply means comprises a cylinder having a volume of about 100 $cm^3$ which is filled at an initial pressure of about 200 bars with a breathable gas containing oxygen, means for expanding the gas to a pressure several times greater than the ambient pressure, and an ejection nozzle connected by the expander means to the cylinder and opening out into an air passage duct for sucking in the air contained in the hood and mixing said air with the gas leaving the nozzle, the delivery rate of the cylinder being about 2 to 4 liters/minutes, the nozzle and the air passage duct forming an assembly having an entrainment ratio of about 10 to 20.

2. Apparatus according to claim 1, characterized in that the nozzle has an outlet diameter of about 0.35 mm.

3. Apparatus according to claim 1, characterized in that a middle portion of the duct forms a mixer of substantially constant section, having a diameter of about 3.5 mm and a length of about 25 mm.

4. Apparatus according to claim 1, characterized in that a downstream portion of the duct is formed by a diffuser so that the pressure of the gases leaving the duct is slightly greater than the ambient pressure, this diffuser comprising a truncated cone shaped portion having an angle at the apex of about 3°.

5. Apparatus according to claim 1, characterized in that the ejection nozzle is fed with gas at a pressure between about 4 and 10 bars.

6. Apparatus according to claim 1, characterized in that the cylinder, the expander means, the carbon dioxide absorbing means, the ejection nozzle and the air passage duct are contained inside the hood.

7. Apparatus according to claim 1, characterized in that the breathing apparatus also comprises water vapour absorbing means such as silica gel.

8. Apparatus according to claim 1, characterized in that expander means are disposed in the path of the air sucked into the duct and leaving the carbon dioxide absorbing means.

9. Apparatus according to claim 1, characterized in that the hood is made from a light and transparent heat resistance material such as polyimide.

10. Apparatus according to claim 1, characterized in that a portion of the external surface of the hood is metal coated.

* * * * *